United States Patent [19]

Barron

[11] 4,152,967

[45] May 8, 1979

[54] PNEUMATIC PIANO ACTION

[76] Inventor: Ellis Barron, 7228 Eads Ave., La Jolla, Calif. 92037

[21] Appl. No.: 827,697

[22] Filed: Aug. 25, 1977

[51] Int. Cl.[2] ..... G10C 3/16

[52] U.S. Cl. ..... 84/236; 84/237; 84/240; 84/440

[58] Field of Search ..... 84/236–240, 84/243–247, 258, 439–440

[56] References Cited

U.S. PATENT DOCUMENTS

| | | | |
|---|---|---|---|
| 1,148,719 | 8/1915 | Sandell | 84/246 |
| 1,680,039 | 8/1928 | Hammond | 84/338 |

FOREIGN PATENT DOCUMENTS

| | | | |
|---|---|---|---|
| 128111 | 2/1962 | Fed. Rep. of Germany | 84/245 |
| 26578 | 2/1924 | France | 84/245 |

*Primary Examiner*—Lawrence R. Franklin

[57] ABSTRACT

An action for a piano type musical instrument in which the hammer striking force is produced by the reaction of a pneumatic piston. For the grand piano embodiment, the hammer pivot is carried by the key-lever and the piston is connected to the hammer butt such that when the instrument is played the resistance of the piston raises the hammer into the musical string. A similar action is shown for the upright piano. In each case the hammer is propelled into the string with a velocity proportional to key-lever velocity and the escape, check and repetition parts of conventional actions are made unnecessary by the inherent properties of the pneumatic piston.

5 Claims, 3 Drawing Figures

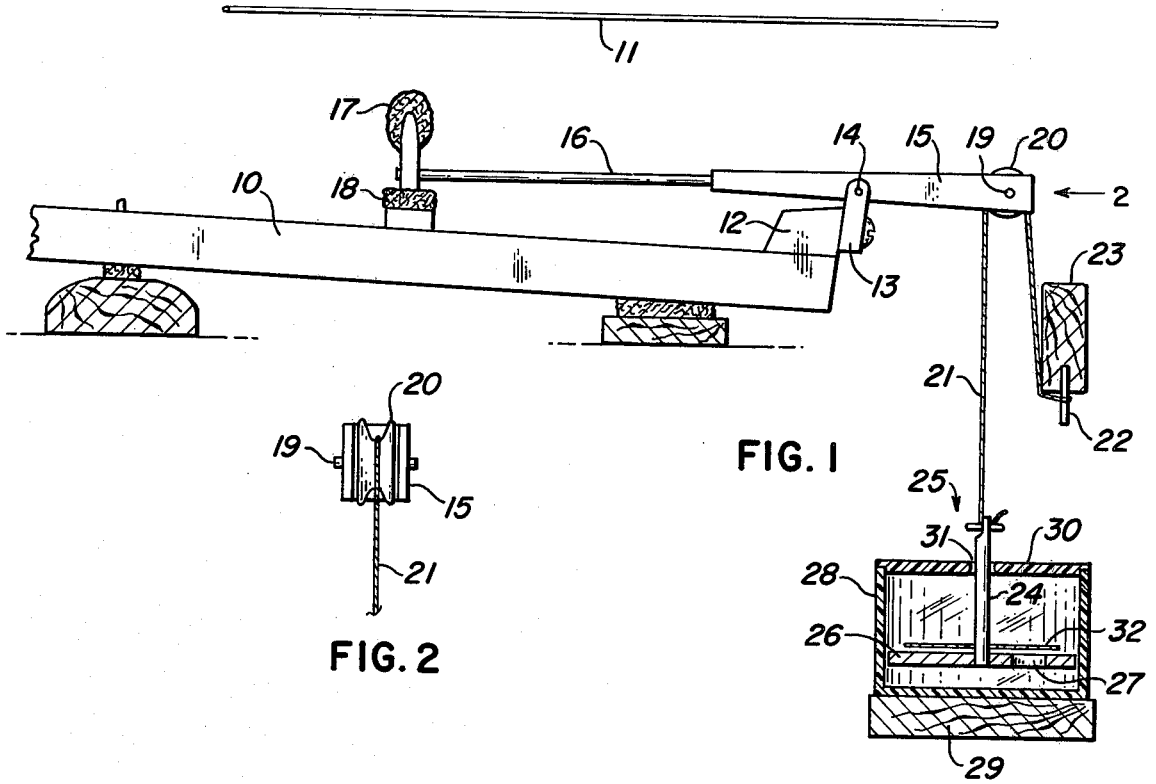
FIG. 1
FIG. 2
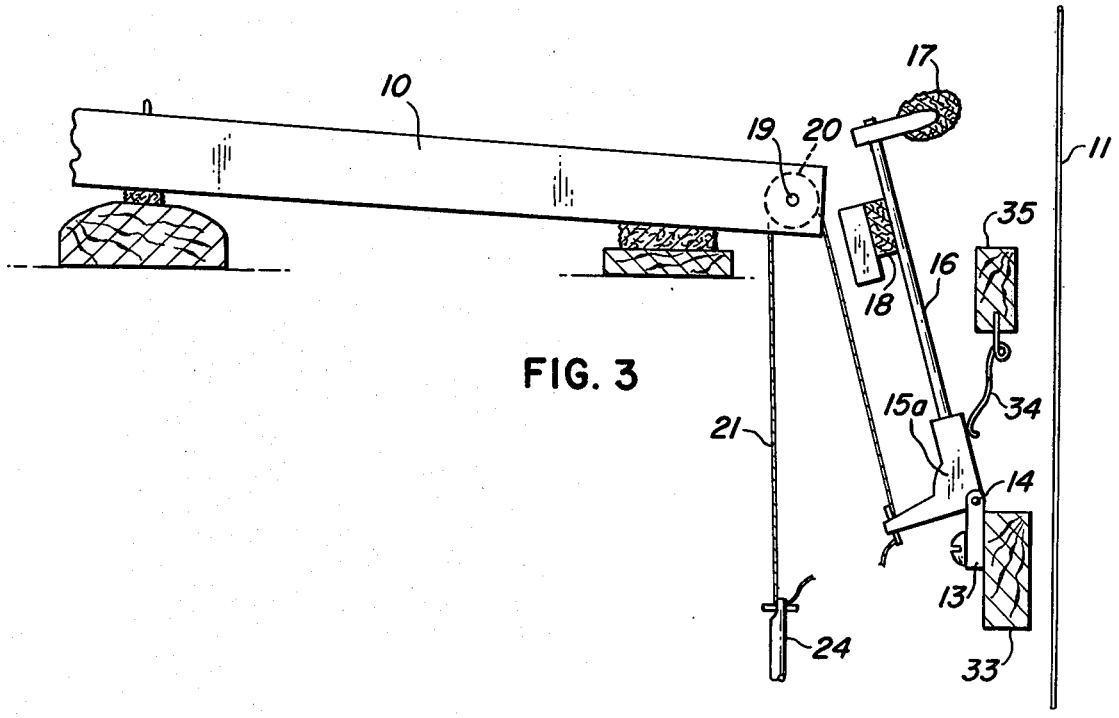
FIG. 3

PNEUMATIC PIANO ACTION

BACKGROUND OF THE INVENTION

Modern grand piano actions utilize a jack or hopper to transmit key motion to the hammer, this device being disengaged as the hammer reaches the string in order that the hammer can rebound therefrom and not block the string. This action is called let off or escapement. The hammer now having escaped must, under heavy playing, be prevented from rebounding so far as to rebound in turn from the hammer rest and return again to block the string. This is done by the check, a pad which catches the hammer as it leaves the string. Finally, a last device is used, the repetition lever. This part supports a portion of the weight of the hammer so as to allow the hopper to regain a position under the hammer without complete release of the key. This provides for a rapid repeat of the hammer blow.

As is shown hereinafter, it is the object of my invention to provide a piano action which performs all four of these functions using a single mechanism, the pneumatic piston. The latter device (1) presents a reaction force to motion thereof which can be used to drive the hammer, (2) presents no resistance at zero drive velocity and so can be used to perform the escape function, (3) is intrinsically self-damping, eliminating the need for a check, and (4) presents the same reaction force regardless of position, thus enabling the repeat function.

SUMMARY OF THE INVENTION

In the grand piano embodiment of my invention, which illustrates the principles of the action and which takes its form from the so-called "Viennese" action, the hammer pivot is carried by the key-lever and a flexible cord attached to the piston is led over a pulley in the hammer butt and returned to a fixed point in the instrument. Thus, when the key-lever is depressed, the hammer pivot is raised and the resistance of the pneumatic piston raises the hammer into the string.

This action as well as that for upright pianos will be more fully described hereinafter and will be shown in detail in the figures where the like numerals represent like parts throughout.

DESCRIPTION OF THE FIGURES

FIG. 1 is a side elevation of the grand piano embodiment of my invention wherein I show that portion of the conventional key-lever opposite the player and wherein I show all parts of the action in the rest position. The pneumatic piston and the co-acting cylinder as well as certain support members are shown in section.

FIG. 2 is an enlarged end view of the hammer butt showing the flexible cord and pulley wheel.

FIG. 3 is a side elevation of my invention as modified for a vertical piano, the parts being the same as in FIG. 1 except for the addition of a hammer return spring and a modified shape of the hammer butt. The pneumatic piston is not shown, it being the same as in FIG. 1.

Turning now to a detailed description of my pneumatic piano action, I refer first to FIGS. 1 and 2, wherein I show as 10 that portion of the conventional key-lever which rises when the instrument is played. Fastened thereon is block 12 carrying hammer flange 13, the latter containing hammer pivot pin 14. I show further the other hammer parts, hammer butt 15, hammer shank 16, hammer head 17, and hammer rest cushion 18. The novelty of my invention is now shown in the following named and described parts. In hammer butt 15 is contained pulley pin 19 carrying pulley wheel 20 over which is led flexible cord 21, one end thereof being tied around pin 22 in support 23, the other end being fixed to piston rod 24. The complete piston 25 comprises piston rod 24 and disc 26, the latter being provided with hole 27. The disc forms a close but free fit to cylinder 28 which is fixed to support 29 and is provided with lid 30, the latter containing guide hole 31. Piston 25 is fitted with a thin gravity sensitive cover 32 which forms a flap valve with hole 27. Such a valve allows a more rapid downward piston motion and, thus, a more rapid hammer repeat motion. Cover 32 is provided with a center guide hole which fits loosely on piston rod 24.

The operation of my invention can now be described as follows. When the instrument is played, hammer pivot 14 will rise and hammer head 17 will rise toward the musical string 11 with a velocity dependent upon the resistance of piston 25. Further, it can be seen that when the hammer pivot 14 reaches the end of it's upward motion, there will be no more hammer upward force exerted by the piston and the piston will act as a damper on the hammer rebound. The weight of the piston and hammer parts as well as the dimensions thereof are made so the hammer remains near the string after the rebound and is thereby ready for a repeat blow without complete release of the key-lever.

Referring now to FIG. 3, I show a modification of my action for vertical piano. Here the musical string 11 is oriented vertically and key-lever 10 carries pulley pin 19 and pulley 20. The flexible cord 21, fixed to piston rod 24 as before, is run over pulley 20 and fixed to an alternately shaped hammer butt **15*a*, the latter being supported by pivot pin 14, hammer flange 13, and support 33. The hammer is provided with return spring 34 mounted in support 35 and bearing on hammer butt 15*a***. The remaining parts of my vertical action, including the hammer and piston parts, are the same as described hereinabove for the grand piano.

The action is also similar but may be described in an alternate manner as follows. An examination of FIG. 3 shows that the hammer motion is the difference between key-lever and piston motion. Thus, if the key-lever end 10 is raised so slowly as to allow complete air flow around piston disc 26, there will be maximum motion of the piston and no motion of the hammer. Conversely, if key-lever motion is so quick as to allow very little air flow and no piston motion, there will be maximum hammer motion.

The detailed description of my invention now being complete, I turn to the following general description. It is obvious that piston resistance is a function of the density of the substance or fluid contained within the cylinder and in the foregoing description attention has been given to the most convenient case, that is, where the substance is air or the atmosphere. In such a case the diameter of the piston, depending upon the fit, is preferably large and for this disclosure is intended to be approximately four (4) times the instrument key spacing. Although not shown, such diameters can be accomodated by arranging the cylinders one in front of the other as referred to the player, and located each such pair one above the other. An alternate method and one forming a claim hereunder is to employ an alternate substance such as oil or water within the cylinder.

The foregoing comprises the essential principles and embodiments of my invention but the disclosure is not meant to be limited thereby and includes in addition to the subjoined claims such other changes and modifications as would occur to those skilled in the subject art.

I claim:

1. An action for a keyboard type musical instrument, comprising:

(a) a hammer having a hammer butt and a hammer pivot;

(b) a key-lever;

(c) a piston;

(d) a closed cylinder fixed in the instrument and slideably containing said piston, the combination providing a velocity dependent resistance force; and (e) means including flexible cord means interconnecting said piston, said hammer butt, and said key-lever such that key-lever motion causes movement of the hammer to strike a musical element in the instrument, said hammer movement acting in opposition to said velocity dependent resistance force.

2. An action as in claim 1, wherein said piston is provided with a hole therein and a cover thereon, the combination acting as a gravity sensitive flap valve.

3. An action as in claim 1, wherein said hammer pivot is mounted on said key-lever, said hammer butt has a pulley mounted thereon, and said cord means includes a cord led over said pulley with one end of the cord fixed in said instrument and the other end of the cord connected to said piston.

4. An action as in claim 1, wherein said hammer pivot is mounted on a fixed portion of said instrument, said key-lever has a pulley mounted thereon, and said flexible cord means includes a cord led over said pulley with one end of the cord connected to said piston and the other end of said cord connected to said hammer butt.

5. A action as in claim 1, wherein said cylinder contains an incompressible bluid therein.

* * * * *